US006300917B1

(12) United States Patent
Leisten et al.

(10) Patent No.: US 6,300,917 B1
(45) Date of Patent: Oct. 9, 2001

(54) ANTENNA

(75) Inventors: Oliver Paul Leisten, Northampton; Mark Roy Dowsett, Coventry, both of (GB)

(73) Assignee: Sarantel Limited, Wellingborough (GB)

( * ) Notice: Subject to any disclaimer, the term of this patent is extended or adjusted under 35 U.S.C. 154(b) by 0 days.

(21) Appl. No.: 09/372,865

(22) Filed: Aug. 12, 1999

(30) Foreign Application Priority Data

May 27, 1999 (GB) ..... 9912441

(51) Int. Cl.[7] ..... H01Q 1/36

(52) U.S. Cl. ..... 343/895; 821/702

(58) Field of Search ..... 343/895, 702, 343/821, 853; 29/600; H01Q 1/24

(56) References Cited

U.S. PATENT DOCUMENTS

| | | |
|---|---|---|
| 2,575,377 | 11/1951 | Wohl . |
| 2,763,003 | 9/1956 | Harris . |
| 3,611,198 | 10/1971 | Ma . |
| 3,633,210 | 1/1972 | Westerman . |
| 3,906,509 | 9/1975 | DuHamel . |
| 3,940,772 | 2/1976 | Ben-dov . |
| 4,008,478 | 2/1977 | Ikarath et al. . |
| 4,008,479 | 2/1977 | Smith . |
| 4,114,164 | 9/1978 | Greiser . |
| 4,148,030 | 4/1979 | Foldes . |
| 4,160,979 | 7/1979 | Drewett . |
| 4,168,479 | 9/1979 | Rubin . |
| 4,204,212 | 5/1980 | Sindoris et al. . |
| 4,270,128 | 5/1981 | Drewett . |

(List continued on next page.)

FOREIGN PATENT DOCUMENTS

| | | |
|---|---|---|
| 3217437 A1 | 11/1983 | (DE) . |
| 0 051 018 B1 | 5/1982 | (EP) . |
| 0 198 578 A1 | 10/1986 | (EP) . |

(List continued on next page.)

OTHER PUBLICATIONS

Nakano, H., "Helical and Spiral Antennas—A Numerical Approach", *Research Studies Press Ltd.*, England, pp. 1–261 (1987).

Krall et al., *IEEE Transactions on Antennas and Propagation*, vol. AP–27, No. 6, Nov. 1979, pp. 850–853.

Casey, J. et al., "Square Helical Antenna with a Dielectric Core", *IEEE Transactions on Electromagnetic Compatibility*, vol. 30, No. 4, Nov. 1988, pp. 429–436.

Espaignol, J. et al., "Duplexeur A Resonateurs Dielectriques En Bande K", *6es Journees Nationales Microondes*, Montpellier, Jun. 21–23, 1989, Centre D'Electronique De Montpellier, pp. 321–322.

*Primary Examiner*—Don Wong
*Assistant Examiner*—Ephrem Alemu
(74) *Attorney, Agent, or Firm*—Fulbright & Jaworski

(57) ABSTRACT

A dielectrically-loaded antenna for operation at frequencies in excess of 200 MHz includes an antenna element structure disposed on a high dielectric constant core, which element structure comprises a pair of laterally opposed groups, of helical antenna elements. Each group comprises first and second mutually adjacent elements, of different thicknesses providing looped conductive paths on the antenna, formed by the first elements of each group and the second elements of each group respectively, which resonate at differing respective resonant frequencies to yield a relatively wide operating bandwidth. The helical elements of each group define, between them, part of an elongate channel which has an overall electrical length in the region of $n\lambda/2$ within the operating frequency band to provide isolation between the looped conductive paths. The major part of each such channel is located between the elements so as to minimise intrusion with other parts of the antenna.

35 Claims, 4 Drawing Sheets

U.S. PATENT DOCUMENTS

| | | |
|---|---|---|
| 4,323,900 | 4/1982 | Krall et al. . |
| 4,329,689 | 5/1982 | Yee . |
| 4,349,824 | 9/1982 | Harris . |
| 4,442,438 | 4/1984 | Siwiak et al. . |
| 4,608,572 | 8/1986 | Blakney et al. . |
| 4,608,574 | 8/1986 | Webster et al. . |
| 4,697,192 | 9/1987 | Hofer et al. . |
| 4,706,049 | 11/1987 | Dydyk . |
| 4,862,184 | 8/1989 | Ploussios . |
| 4,902,992 | 2/1990 | Rubin et al. . |
| 4,910,481 | 3/1990 | Sasaki et al. . |
| 4,940,992 | 7/1990 | Nguyen et al. . |
| 4,980,694 | 12/1990 | Hines . |
| 5,019,829 | 5/1991 | Heckman et al. . |
| 5,023,866 | 6/1991 | De Muro . |
| 5,055,852 | 10/1991 | Dusseux et al. . |
| 5,081,469 | 1/1992 | Bones . |
| 5,099,249 | 3/1992 | Seavey . |
| 5,134,422 | 7/1992 | Auriol . |
| 5,170,176 | 12/1992 | Yasunaga et al. . |
| 5,170,493 | 12/1992 | Roth . |
| 5,255,005 | 10/1993 | Terret et al. . |
| 5,258,728 | 11/1993 | Taniyoshi et al. . |
| 5,281,934 | 1/1994 | Shiau et al. . |
| 5,298,910 | 3/1994 | Takei et al. . |
| 5,329,287 | 7/1994 | Strickland . |
| 5,341,149 | 8/1994 | Valimaa et al. . |
| 5,345,248 | 9/1994 | Hwang et al. . |
| 5,346,300 | 9/1994 | Yamamoto et al. . |
| 5,349,361 | 9/1994 | Egashira et al. . |
| 5,349,365 | 9/1994 | Ow et al. . |
| 5,406,296 | 4/1995 | Egashira et al. . |
| 5,406,693 | 4/1995 | Egashira et al. . |
| 5,450,093 | 9/1995 | Kim . |
| 5,479,180 | 12/1995 | Lenzing et al. . |
| 5,541,613 | 7/1996 | Lam et al. . |
| 5,548,255 | 8/1996 | Spielman . |
| 5,612,707 | 3/1997 | Vaughan et al. . |
| 5,748,154 | 5/1998 | Yokota . |
| 5,854,608 | 12/1998 | Leisten . |
| 5,859,621 | 1/1999 | Leisten . |
| 5,945,963 | 8/1999 | Leisten . |
| 5,963,180 | 10/1999 | Leisten . |

FOREIGN PATENT DOCUMENTS

| | | |
|---|---|---|
| 0 241 921 A1 | 10/1987 | (EP) . |
| 0 332 139 A3 | 9/1989 | (EP) . |
| 0 429 255 A2 | 11/1990 | (EP) . |
| 0 465 658 A1 | 1/1992 | (EP) . |
| 0 469 741 A1 | 2/1992 | (EP) . |
| 0 521 511 A2 | 1/1993 | (EP) . |
| 0 320 404 B1 | 3/1993 | (EP) . |
| 0 588 271 A1 | 3/1994 | (EP) . |
| 0 588 465 A1 | 3/1994 | (EP) . |
| 0 590 534 A1 | 4/1994 | (EP) . |
| 0 652 645 A1 | 5/1995 | (EP) . |
| 0 777 293 A1 | 6/1997 | (EP) . |
| 0 791 978 A2 | 8/1997 | (EP) . |
| 2570546 A1 | 3/1986 | (FR) . |
| 2603743 | 3/1988 | (FR) . |
| 762415 | 11/1956 | (GB) . |
| 840850 | 7/1960 | (GB) . |
| 1198410 | 7/1970 | (GB) . |
| 1568436 | 5/1980 | (GB) . |
| 2 202 380 A | 9/1988 | (GB) . |
| 2196483 B | 3/1990 | (GB) . |
| 2 243 724 B | 11/1991 | (GB) . |
| 2 246 910 A | 2/1992 | (GB) . |
| 2 248 344 B | 4/1992 | (GB) . |
| 2 292 257 A | 2/1996 | (GB) . |
| 2 292 638 A | 2/1996 | (GB) . |
| 2 309 592 A | 7/1997 | (GB) . |
| 2 310 543 A | 8/1997 | (GB) . |
| 2 311 675 A | 10/1997 | (GB) . |
| 2 317 057 A | 3/1998 | (GB) . |
| 2 321 785 A | 8/1998 | (GB) . |
| 2 326 532 A | 12/1998 | (GB) . |
| 3-274904 | 12/1991 | (JP) . |
| 7-249973 | 9/1995 | (JP) . |
| 8-8408 | 1/1996 | (JP) . |
| 1483-511 | 5/1989 | (SU) . |
| WO 91/11038 | 7/1991 | (WO) . |
| WO 92/05602 | 4/1992 | (WO) . |
| WO 92/17915 | 10/1992 | (WO) . |
| WO 93/22804 | 4/1993 | (WO) . |
| WO 94/27338 | 5/1994 | (WO) . |
| WO 94/21001 | 9/1994 | (WO) . |
| WO 96/06468 | 2/1996 | (WO) . |
| WO 97/27642 | 7/1997 | (WO) . |
| WO 98/24144 | 6/1998 | (WO) . |

ANTENNA

FIELD OF THE INVENTION

This invention relates to a dielectrically-loaded antenna for operation at frequencies in excess of 200 MHz, and in particular to an antenna having at least two resonant frequencies within a band of operation.

BACKGROUND OF THE INVENTION

Such an antenna is disclosed in United Kingdom Patent Application No. GB2321785A. This known antenna has a pair of laterally opposed elongate antenna elements which extend between longitudinally spaced-apart positions on a solid dielectric core, the antenna elements being connected at respective first ends to a feed connection and at second ends to a balun sleeve. The antenna elements and sleeve are arranged so as to form at least two conductive paths extending around the core, wherein one of the two paths has an electrical length which is greater than that of the other path at an operating frequency of the antenna. This is achieved using forked antenna elements, wherein each element having a divided portion extending from a position between the top of the dielectric core and the rim of the balun sleeve, the divided portion of at least one of the antenna elements having branches of different electrical lengths. The balun sleeve is split in the sense that longitudinally extending slits are formed as breaks in the conductive material of the sleeve so as to provide isolation between the two sleeve parts, thus defining the two conducting paths. The balun slits are arranged to have an electrical length of about a quarter wavelength ($\lambda/4$) in the operating frequency band, the zero impedance point provided by the rim of the sleeve being transformed to a high impedance point between the divided elements, thereby isolating the sleeve parts from one another. As a result of the conductive paths having different electrical lengths, each conductive path resonates at a different frequency and so provides an antenna having a relatively wide bandwidth.

One problem associated with the above antenna is that it is difficult to incorporate slits of sufficient length within the sleeve to provide the quarter wavelength, especially if the sleeve is short. The L-shaped slits disclosed in GB2321785A can be difficult to manufacture and restrict the flow of currents in the sleeve.

SUMMARY OF THE INVENTION

According to a first aspect of the invention, there is provided a dielectrically-loaded antenna for operation at frequencies in excess of 200 MHz, comprising an electrically insulative core of a solid material having a relative dielectric constant greater than 5, a feed connection, and an antenna element structure disposed on or adjacent the outer surface of the core, the material of the core occupying the major part of the volume defined by the core outer surface, wherein the antenna element structure comprises a pair of laterally opposed groups of elongate elements, each group comprising first and second mutually adjacent elongate elements, which have difference electrical lengths at a frequency within an operating frequency band of the antenna and are coupled together at respective first ends in the region of the feed connection and at respective second ends by a linking conductor extending around the core, the elongate elements of each group thereby defining at least part of an elongate channel which has an electrical length of $n\lambda/2$ within the said band, and the major part of which is located between the elements and wherein the first elements of the two groups form part of a first looped conductive path, and the second elements of the two groups form part of a second looped conductive path, such that the said paths have difference respective resonant frequencies within the said band and each extend from the feed connection to the linking conductor, and then back to the feed connection.

Other aspects of the invention, as well as preferred features, are set out in the accompanying claims.

The $n\lambda/2$ channel, or slit, makes it possible to provide isolation between conductive loops formed by the antenna elements and linking conductors. Since the major part of this channel is located between the antenna elements, intrusion into other parts of the antenna is reduced. Preferably, the entire channel is located between the antenna elements.

By arranging for the elongate elements and linking conductors to form at least two looped conductive paths with the electrical length of one of the two paths greater than that of the other path at an operating frequency of the antenna, a frequency response with at least two resonant peaks is produced yielding an antenna with relatively wide bandwidth. Indeed, the resonant frequencies can be selected to coincide with the centre frequencies of the transmit and receive bands of a mobile telephone system.

The linking conductor may be formed by a quarter wave balun on the outer surface of the core adjacent the end opposite to the feed connection, this feed connection being provided by a feeder structure extending longitudinally through the core. In one preferred embodiment, the linking conductor is formed by an integral balun sleeve, or trap, each of the conductive paths including the rim of the sleeve. Alternatively, each linking conductor may be formed by a conductive strip extending around the core. The advantage of a balun sleeve is that the antenna may operate in a balanced mode from a single-ended feed coupled to the feeder structure.

In the preferred antenna there are two looped conductive paths extending around the core, each looped path extending from the feed connection, through first or second antenna elements (depending on the operating frequency) of a first group, to the linking conductor, and returning through respective first or second elements of a second group back to the feed connection. The difference in electrical length between the antenna elements in each group, and so between the two looped conductive paths, may be achieved by forming one of the elements in each group of a different width to the other element or elements in the group. In effect, the elements act as waveguides, the wider element propagating signals at a lower velocity than the narrower elements. Alternatively, one of the elements in each group may have a different physical length from the other element or elements in that group.

In the preferred embodiment, the antenna core is generally cylindrical and the feed connection is located on an end-face of the core, each of the elongate elements in each group being coupled together on the end face. The core defines a central axis and the antenna elements are substantially coextensive in the axial direction, each element extending between axially spaced-apart positions on or adjacent the outer surface of the core such that at each of the spaced apart positions, the respective spaced-apart portions of the antenna elements lie substantially in a single plane containing the central axis of the core. In this case, each group of elongate elements comprises first and second antenna elements, the looped conductive paths extending from the feed connection, through first and second antenna elements of a first group of elements to the linking conductor, in the form of the balun sleeve, and returning through the respective first or second antenna elements of a second group of elements to the feed connection. The antenna elements are helical, executing a half-turn around the core. Such a structure yields an antenna radiation pattern having laterally directed nulls perpendicular to the single plane.

The antenna of the preferred embodiment actually has four modes of resonance. This is due to the provision of the balun sleeve, which provides for both single-ended and balanced modes of resonance involving current paths around the balun rim and through the balun respectively. The use of coupled modes in this way is disclosed in our co-pending British Patent Application No. 9813002.4, the contents of which are incorporated herein by references. Accordingly, two modes of resonance are associated with each of the two elements in each group, i.e. one single-ended mode and one balanced mode, the resulting frequency response having four resonant peaks, thereby providing even greater bandwidth. The modes of resonance may typically generate a response within the 3 dB limits over a fractional bandwidth of at least 5%, preferably 8%, with a value up to about 11% being attained by the antenna of the preferred embodiment described below. Such a response makes the antenna particularly suited to mobile telephone use, e.g. in the 1710 MHz to 1880 MHz DCS-1800 band or the combined PCS-DCS 1900 band.

The invention includes an antenna for operation at frequencies in excess of 200 MHz, comprising an electrically insulative core of a solid material having a relative dielectric constant greater than 5, a feed connection, and an antenna element structure disposed on or adjacent the outer surface of the core comprising first and second pairs of antenna elements, the elements of each pair being disposed substantially diametrically opposite one another, the material of the core occupying the major part of the volume defined by the core outer surface, wherein the elements of the second pair are formed having a greater width than that of the first pair of elements. Such an antenna is particularly suited for receiving circularly polarised signals, such as those transmitted by satellites of the Global Positioning System at about 1575 MHz. Such antennas are usually arranged to have two pairs of elements, one of the pairs having elements which are longer than the other pair. The differing lengths produce the phase shift conditions for receiving circularly polarised signals. Since the second pair of antenna elements referred to above in connection with the present invention are formed wider than the first pair, the elements have a longer electrical length than those of the first pair (even though they may have the same physical length). Unlike previous GPS-type receiving antennas, in which the physical lengths of the elements are different, the antenna disclosed herein can be produced using elements of substantially the same physical length avoiding complex shaping of the elements or coupling conductors.

The invention will be described below by way of example with reference to the drawings. In the drawings:

DETAILED DESCRIPTION OF THE PREFERRED EMBODIMENTS

Figure 1:
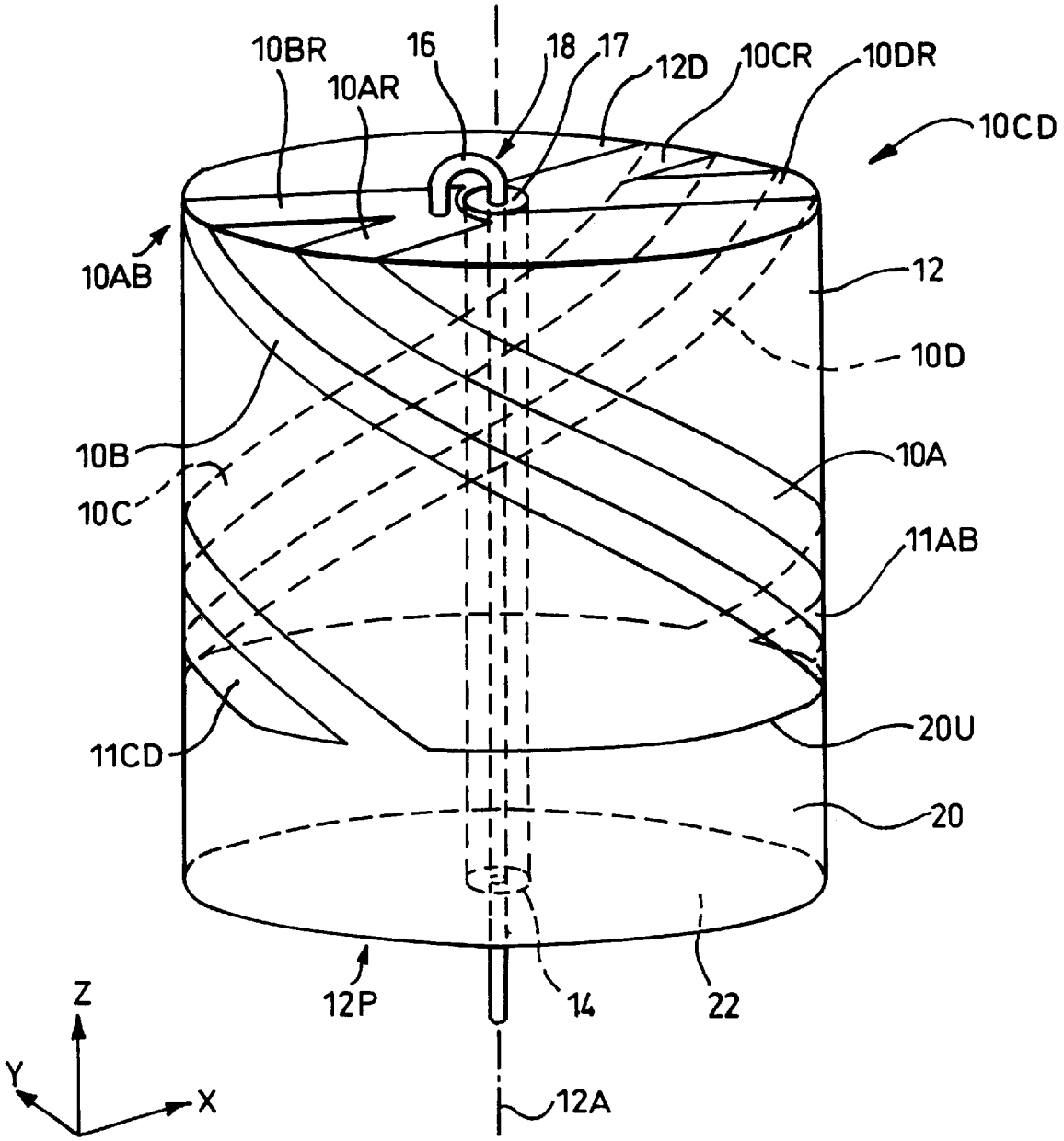
FIG. 1 is a perspective view of an antenna in accordance with the invention.

Referring to FIG. 1, a preferred antenna in accordance with the invention has an antenna element structure comprising a single pair of laterally opposed antenna groups 10AB, 10CD. Each group comprises two mutually adjacent and generally parallel elongate antenna elements 10A, 10B, 10C, 10D which are deposited on the outer cylindrical surface of an antenna core 12. The core 12 has an axial passage 14 with an inner metallic lining, the passage 14 housing an axial inner feeder conductor 16 surrounded by a dielectric insulating sheath 17. The inner conductor 16 and the lining together form a feeder structure 18 for coupling a feed line to the antenna elements 10A–10D at a feed position on the distal end face 12D of the core 12. The antenna element structure includes corresponding radial elements 10AR, 10BR, 10CR, 10DR formed as metallic conductors on the distal end face 12D connecting first ends of the elements 10A–10D to the feeder structure.

In this embodiment, the longitudinally extending elements 10A–10D and the corresponding radial elements are of approximately the same physical length, each element 10A–10D being in the form of a helix executing a half turn around the axis of the core 12. Each group of antenna elements comprises first elements 10A, 10C and second elements 10B, 10D. The first elements 10A, 10C of both groups are arranged to have a different electrical length to the second elements 10B, 10D of each group, due to the first elements having a width which is greater than the width of the second elements. It will be appreciated that the wider elements will propagate signals at a velocity which is lower than is the case for the narrower elements.

To form complete conductive loops, each antenna element (10A–10D) is connected to the rim 20U of a common virtual ground conductor in the form of a conductive sleeve 20 surrounding a proximal end portion of the core 12 as a link conductor for the elongate elements 10A–10D. The sleeve 20 is in turn connected to the lining of the axial passage 14 by plating on the proximal end face 12D of the core 12. Thus, conductive loops are formed by either of the first or second antenna elements of the first group 10AB, the rim of the sleeve 20U, and the corresponding first or second antenna element of the second group 10CD.

At any given transverse cross-section though the antenna, the first and second antenna elements of the first group 10AB are substantially diametrically opposed to corresponding first or second elements of the second group 10CD. It will be noted that the ends of the antenna elements all lie substantially in a common plane containing the axis of the core, and indicated by the axes X and Z of the co-ordinate system indicated in FIG. 1.

The conductive sleeve 20 covers a proximal portion of the antenna core 12, surrounding the feeder structure 18, the material of the core filling substantially the whole of the space between the sleeve 20 and the metallic lining of the axial passage 14. The combination of the sleeve 20 and plating forms a balun so that signals in the transmission line formed by the feeder structure 18 are converted between an unbalanced state at the proximal end of the antenna and a balanced state at an axial position above the plane of the upper edge 20U of the sleeve 20. To achieve this effect, the axial length of the sleeve is such that in the presence of an underlying core material of relatively high dielectric constant, the balun has an electrical length of about λ/4 or 90° in the operating frequency band of the antenna. Since the core material of the antenna has a foreshortening effect, and the annular space surrounding the inner conductor is filled with an insulating dielectric material having a relatively small dielectric constant, the feeder structure 18 distally of the sleeve has a short electrical length. As a result, signals at the distal end of the feeder structure 18 are at least approximately balanced. A further effect of the sleeve 20 is that for frequencies in the region of the operating frequency of the antenna, the rim part 20U of the sleeve 20 is effectively isolated from the ground represented by the outer conductor of the feeder structure. This means that currents circulating between the antenna elements 10A–10D are confined substantially to the rim part. The sleeve thus acts as an isolating trap when the antenna is resonant in a balanced mode.

Since the first and second antenna elements of each group 10AB, 10CD are formed having different electrical lengths at a given frequency, the conductive loops formed by the elements also have different electrical lengths. As a result, the antenna resonates at two different resonant frequencies, the actual frequency being dependent, in this case, on the width of the elements. As FIG. 1 shows, the generally parallel elements of each group extend from the region of the feed connection on the distal end face of the core to the rim 20U of the balun sleeve 20, thus defining an inter-element channel 11AB, 11CD, or slit, between the elements of each group.

The length of the channels are arranged to achieve substantial isolation of the conductive paths from one another at their respective resonant frequencies. This is achieved by forming the channels with an electrical length of λ/2, or nλ/2 where n is an odd integer. At the resonant frequency of one of the conductive loops, a standing wave is set up over the entire length of the resonant loop, with equal values of voltage being present at locations adjacent the ends of each λ/2 channel, i.e. in the regions of the ends of the antenna elements. When one of the loops is resonating, the antenna elements which form part of the non-resonating loop are isolated from the adjacent resonating elements, since equal voltages at either ends of the non-resonant elements result in zero current flow. When the other conductive path is resonant, the other loop is likewise isolated from the resonating loop. To summarise, at the resonant frequency of one of the conductive paths, excitation occurs in that path simultaneously with isolation from the other path. It follows that at least two quite distinct resonances can be achieved at different frequencies due to the fact that each branch loads the conductive path of the other only minimally when the other is at resonance. In effect, two or more mutually isolated low impedance paths are formed around the core.

In the preferred embodiment, the channels 11AB, 11CD are located entirely between the antenna elements 10A, 10B and 10C, 10D respectively. The channels may extend by a relatively small distance into the sleeve 20, but the major part of the overall length of each channel 11AB, 11CD is located between the antenna elements. Typically, for each channel, the length of the channel part located between the elements would be no less than 0.7 L, where L is the total physical length of the channel.

As mentioned previously, due to the inclusion of the balun sleeve 20 as the link conductor, the antenna is operable in a balanced mode in which currents flowing between elements of each group are confined to the rim 20U of the sleeve 20. Advantageously, the antenna also exhibits a single-ended mode of operation at different frequencies, whereby currents flow from one antenna element of each group of elements, longitudinally through the balun sleeve 20, and via the plated end face 10P to the axial metallic inner lining of the feeder structure at the distal end of the antenna. Thus, in addition to the two previously discussed modes of resonance, i.e. those which are due to balanced mode resonance of the two conductive loops, two further conduction paths are provided in single-ended mode of operation. Since the conductive paths associated with single-ended operation have different electrical lengths from the looped paths in the balanced mode, four resonant peaks are present in the overall frequency response, the antenna therefore exhibiting correspondingly wide bandwidth.

The antenna is preferably formed using a zirconium tin titanate dielectric material, having a relative dielectric constant $\epsilon_r$ of 36. Referring to FIG. 1, the core of the preferred antenna has a diameter of 10 mm and an axial length of 12.1 mm. The helical antenna elements 10A–10D each execute a half-turn around the core 12D and have a pitch angle of about 26° from the upper rim of the sleeve. The balun sleeve itself has a longitudinal length of 4.2 mm, measured from the proximal end face of the core. The width of the first (wide) elements 10A, 10C of each group is 1.15 mm, whilst the width of the second (narrow) elements is 0.75 mm. The spacing between the elements (i.e. the width of the channel) is 1 mm, the element separation when measured from the center of each element being 4.31 mm. At to the distal end face of the core, the diameter of the feeder structure 14 is 2 mm, whilst the widths of the radial element portions 10AR, 10CR and 10BR, 10DR corresponding to the respective first and second elements of each group are 1.9 mm and 1.67 mm respectively.

Figure 2:
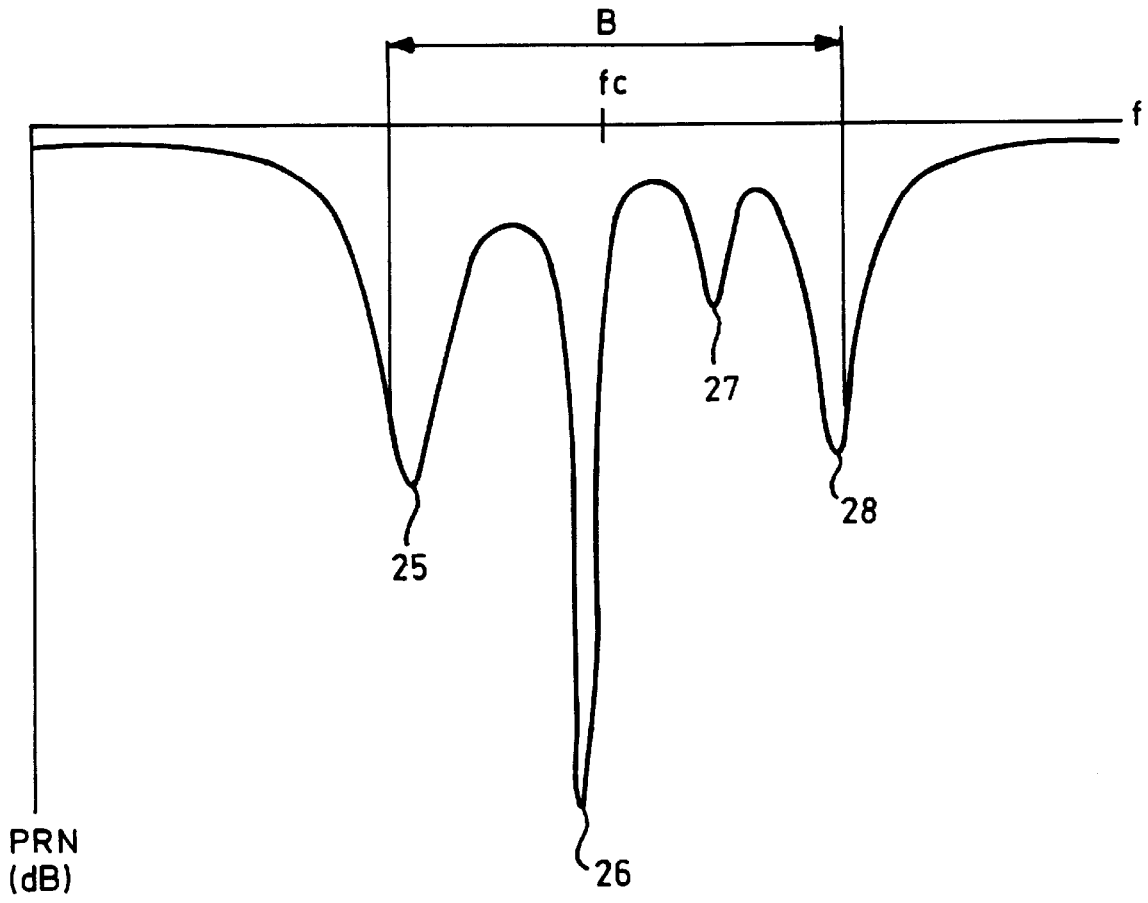
FIG. 2 is a graph showing the return loss response of the antenna of FIG. 1.

FIG. 2 illustrates the variation of the return loss of the above-described antenna with frequency. As shown, the characteristic has four resonant peaks. Peak 25 occurs at about 1.74 GHz and corresponds to the path formed by the first (wide) elements in the single-ended mode, peak 26 occurs at 1.8 GHz and corresponds to the path formed by the first elements in the balanced mode, peak 27 occurs at 1.86 GHz and corresponds to the path formed by the second (narrower) elements in the single-ended mode, and peak 28 occurs at 1.88 GHz and corresponds to the path formed by the second elements in the balanced mode. It will be appreciated that since the wider elements have a greater value of self-capacitance, they produce peaks at lower frequencies than the narrower elements. The width of the operating band B (measured from the −3 dB points) is approximately 195 MHz. The antenna is particularly suited to operation in the 1710 MHz to 1880 MHz DCS-1800 band or the combined PCS-DCS 1900 band, both bands being used for cellular telephone applications.

The antenna exhibits a usable fractional bandwidth in the region of 0.11 (11%), the fractional bandwidth being defined as the ratio of the width of the operating band B to the center frequency $f_c$ of the band, the return loss of the antenna within the band being at least 3 dB less than the average return loss outside the band. The return loss is defined as $20\log_{10}(Vr/Vi)$ where Vr and Vi are the magnitudes of the reflected and incident r.f. voltages at a feed termination of the feeder structure. The relatively wide fractional bandwidth allows the use of relatively low tolerance manufacturing techniques.

Figure 3:
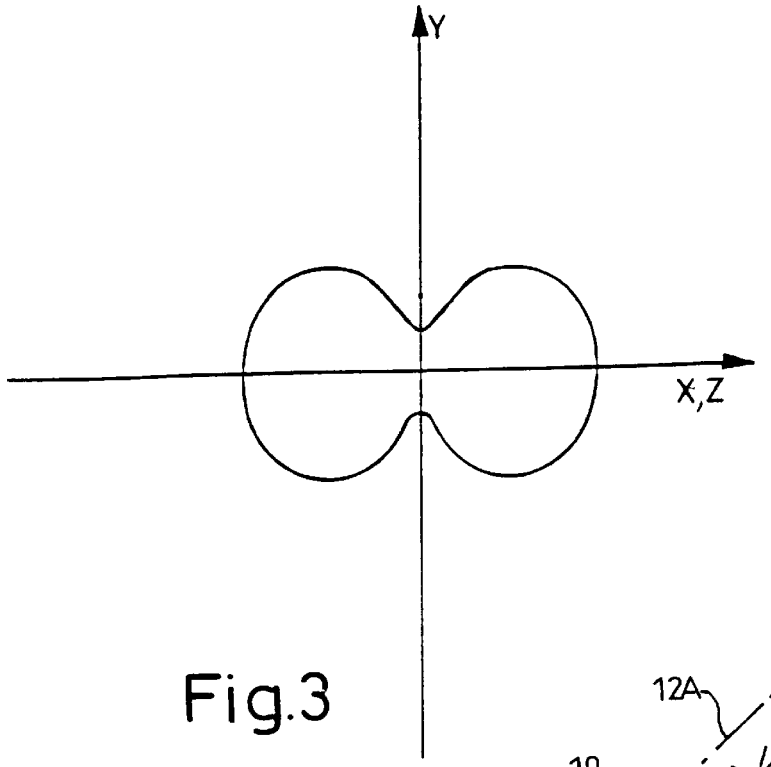
FIG. 3 is a diagram illustrating the radiation pattern of the antenna of FIG. 1.
Figure 4:
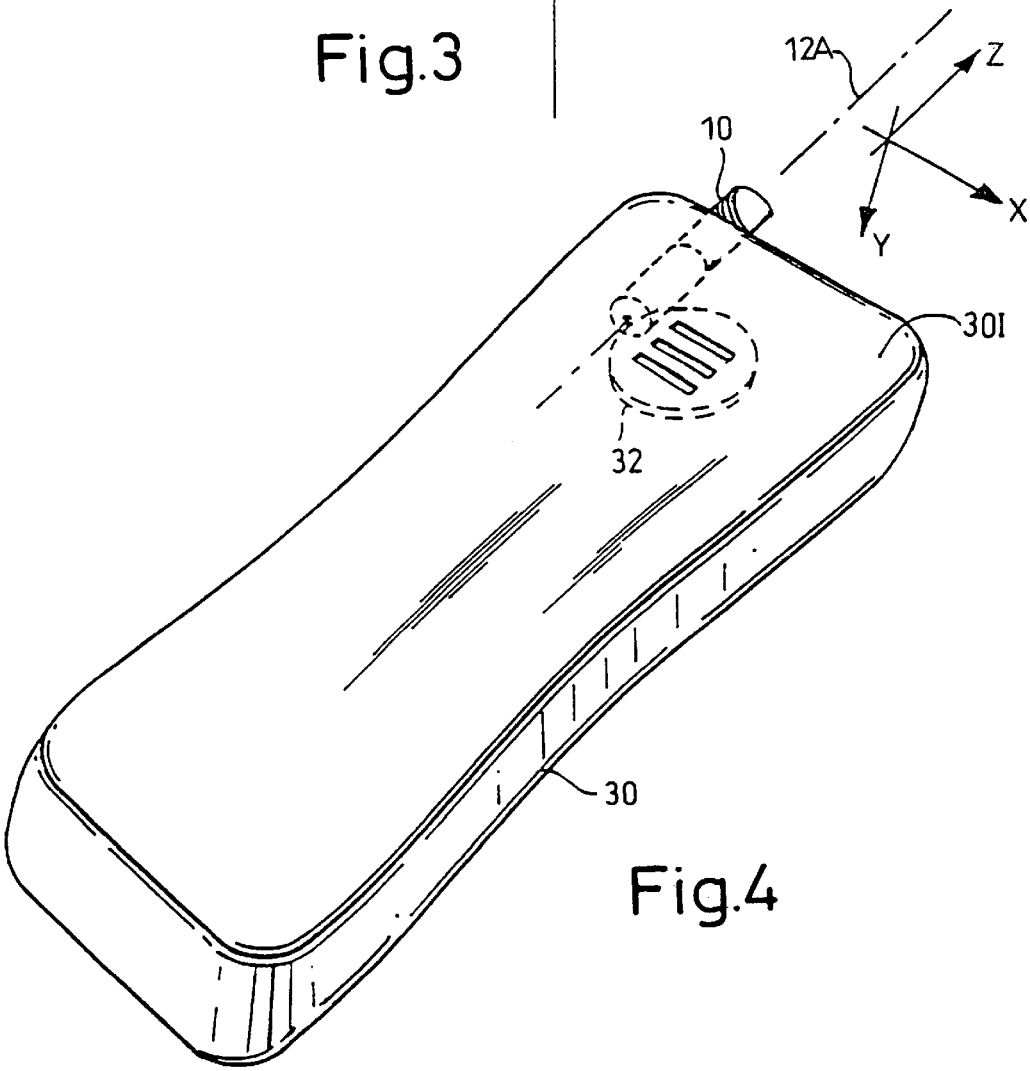
FIG. 4 is a perspective view of a telephone handset incorporating the antenna of FIG. 1.

The antenna element structure with half-turn helical elements lying generally in a single plane performs in a manner similar to a simple planar loop, having a null in its radiation pattern in a direction transverse to the axis 12A and perpendicular to the plane when operated in a balanced mode. The radiation pattern is, therefore, approximately of a figure-ofeight form in both vertical and horizontal planes, as shown by FIG. 3. Orientation of the radiation pattern with respect to the perspective view of FIG. 1 is shown by the axis system comprising axes X, Y, Z shown in both FIG. 1 and FIG. 3. The radiation pattern has two nulls or notches, one on each side of the antenna, and each centered about the Y axis shown in FIG. 1. If the antenna is used in a mobile telephone handset, as is shown in FIG. 4, the antenna is oriented such that one of the nulls is directed towards a user's head to reduce radiation in that direction.

The conductive balun sleeve 20 and the conductive layer on the proximal end face of the core allow the antenna to be directly securely mounted on a printed circuit board or other grounded structure. It is possible to mount the antenna either wholly within a telephone handset unit, or partially projecting as shown in FIG. 4.

As an alternative to forming mutually adjacent element of each group 10AB, 10CD as elements of different widths, the elements of each group may be made to have different electrical lengths by forming them with different physical lengths, e.g. by meandering one of them.

A second embodiment of the invention will now be described with reference to FIG. 5. This antenna is suited to the reception of circularly polarised signals such as those transmitted by satellites of the Global Positioning System (GPS). Such an antenna is disclosed in our prior British Patent Application No. GB2292638A, the entire disclosure of which is incorporated in this application so as to form part of the subject matter of this application as filed. The prior application discloses a quadrifilar antenna having two pairs of diametrically opposed helical antenna elements, the elements of the second pair following respective meandered paths which deviate on either side of a mean helical line on an outer cylindrical surface of the core so that the elements of the second pair are longer than those of the first pair which follow helical paths without deviation. Such variation in the element lengths makes the antenna suitable for transmission or reception of circularly polarised signals. A further quadrifilar antenna is disclosed in our British Patent Application GB2310543A, in which the antenna elements are connected to a plated sleeve on the end of the core. The sleeve is formed having a non-planar rim, such that the antenna elements of a first pair are joined to the linking edge of the sleeve at points which are nearer to the feeder structure at the other end of the core than are the points at which the elements of the first pair are joined to the linking edge.

Figure 5:
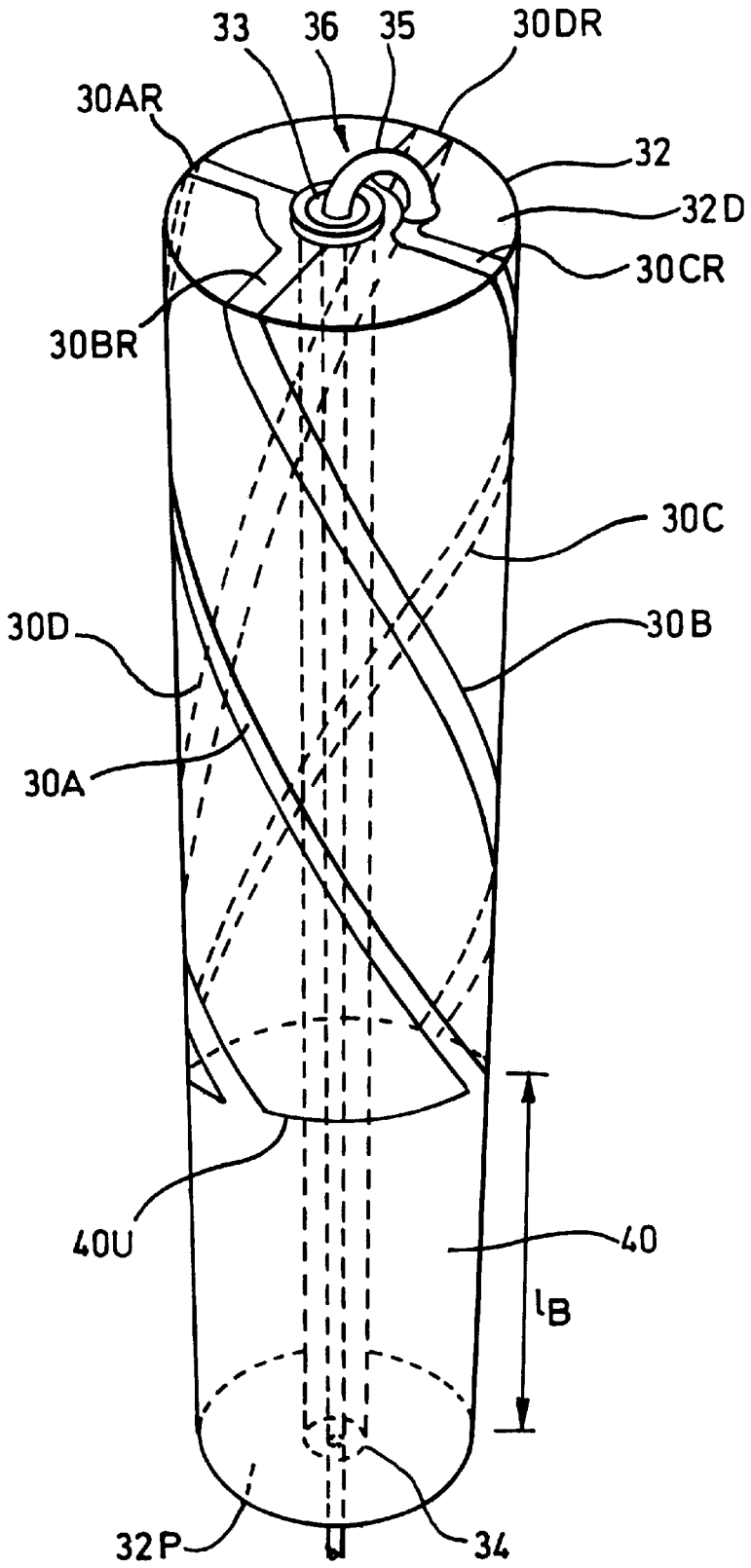
FIG. 5 is a perspective view of a further antenna in accordance with the invention.

Referring to FIG. 5, a quadrifilar antenna in accordance with the present invention has an antenna element structure with four longitudinally extending antenna elements 30A–30D formed as metallic conductor tracks on the cylindrical outer surface of a ceramic core 32. The core 32 has an axial passage 33 with an inner metallic lining 34, and the passage houses an axial feeder conductor 35. The inner conductor 35 and the lining in this case form a feeder structure 36 for connecting a feed line to the antenna elements. The antenna element structure also includes corresponding radial antenna elements 30AR–30DR formed as metallic tracks on a distal end face 32D of the core connecting ends of the respective longitudinally extending elements to the feeder structure 36. The other ends of the antenna elements are connected to a common virtual ground conductor in the form a plated sleeve 40 surrounding a proximal end portion of the core. This sleeve 40 is in turn connected to the lining of the axial passage 33 by plating on the proximal end face of the core.

As will be seen from FIG. 5, the four longitudinally extending elements 30A–30D are of different widths, two of the elements being wider than the other two. The elements of each pair are diametrically opposite each other on opposite sides of the core axis.

In order to maintain approximately uniform radiation resistance for the helical elements, each element follows a simple helical path. Each of the elements subtends the same angle of rotation at the core axis, here 180° or a half turn. The upper linking edge 40U of the sleeve is substantially planar.

Each pair of longitudinally extending elements and corresponding radial elements constitutes a conductor having a predetermined electrical length. In this case, the electrical length is determined not only by the physical length of the antenna elements, but also by the width of the elements. In effect, the antenna elements may be regarded as waveguides. As will be appreciated by those skilled in the art, a wide element will propagate an applied signal at a wave velocity which is lower than that propagated by a narrower element. In the present embodiment, the total electrical length of each of the narrow element pairs is arranged to correspond to a transmission delay of approximately 135° at the operating wavelength, whereas each of the wide element pairs produce a longer delay, corresponding to substantially 225°. Thus, the average transmission delay is 180°, equivalent to an electrical length of $\lambda/2$ at the operating wavelength. The differing element widths produce the required phase shift conditions for a quadrifilar helix antenna for circularly polarised signals, as specified in Kilgus, "Resonant Quadrifilar Helix Design", The Microwave Journal, December 1970, pages 49–54.

Two of the element pairs e.g. elements 30A, 30B (i.e. one wide element and one narrow element) are connected at the inner ends of the radial elements 30AR and 30BR to the inner conductor 35 of the feeder structure 36 at the distal end of the core, while the radial elements 30CR, 30DR of the other two element pairs are connected to the feeder screen formed by the metallic lining of the core inner passage. At the distal end of the feeder structure 36, the signals present on the inner conductor 35 and the feeder screen are approximately balanced so that the antenna elements are present with an approximately balanced source or load.

With the left-handed sense of the helical paths of the longitudinally extending elements, the antenna has its highest gain for right-hand circularly polarised signals. If the antenna is to be used instead for left-hand circularly polarised signals, the direction of the helices is reversed and the pattern of connection of the radial elements is rotated through 90°. In the case of an antenna suitable for receiving both left-hand and right-hand circularly polarised signals, the longitudinally extending elements can be arranged to follow paths which are generally parallel to the axis.

The conductive sleeve 40 covers a proximal portion of the antenna core, thereby surrounding the feeder structure 36, with the material of the core filling the whole of the space between the sleeve 40 and the metallic lining of the axial passage 33. The sleeve 40 forms a cylinder having an axial length $l_B$ and is connected to the lining by the plating of the proximal end face of the core. The combination of the sleeve 40 and plating forms a balun so that signals in the transmission line formed by the feeder structure 36 are converted between an unbalanced state at the proximal end of the antenna and an approximately balanced state at an axial position generally at the same or a greater distance from the proximal end as the upper linking edge 40U of the sleeve. To achieve this effect, the average sleeve length is such that, in the presence of an underlying core material of relatively high relative dielectric constant, the balun has an average electrical length of $\lambda/4$ at the operating frequency of the antenna. Since the core material of the antenna has a foreshortening effect, and the annular space surrounding the inner conductor is filled with an insulating dielectric material having a relatively small dielectric constant, the feeder structure distally of the sleeve has a short electrical length. Consequently, signals at the distal end of the feeder structure are at least approximately balanced. The dielectric constant of the insulation in a semi-rigid cable is typically much lower than that of the ceramic core material referred to above. For example, the relative dielectric constant $e_r$ of PTFE is about 2.2.

The trap formed by the sleeve 40 provides an annular path along the linking edge for currents between the elements, effectively forming two loops, the first including the narrow antenna elements and the second including the wide antenna elements. At quadrifilar resonance, current maxima exist at the ends of the elements and the linking edge 40U, and voltage maxima at a level approximately midway between the edge 40U and the distal end of the antenna. The edge 40U is effectively isolated from the ground connector at its proximal edge due to the quarter wavelength trap produced by the sleeve 40.

The antenna has a main resonant frequency of 500 MHz or greater, the resonant frequency being determined by the effective electrical lengths of the antenna elements 30A–30D. The electrical lengths of the elements, for a given frequency of resonance, are also dependent on the relative dielectric constant of the core material, the dimensions of the antenna being substantially reduced with respect to an air-cored similarly constructed antenna.

The preferred material for the core is zirconium-titanate-based material. This material has the above-mentioned relative dielectric constant of 36 and is noted also for its dimensional and electrical stability with varying temperature. Dielectric loss is negligible. The core may be produced by extrusion or pressing.

The antenna elements are metallic conductor tracks bonded to the outer cylindrical and end surfaces of the core.

As will be appreciated, since the elements have different electrical lengths by virtue of them having different widths, the elements may be formed having substantially similar physical lengths. Further, complicated element and/or sleeve constructions are not required and the design and manufacturing process is consequently more straightforward.

With a core having a substantially higher relative dielectric constant than that of air, e.g. $\epsilon_r$=36, an antenna as described above for L-band GPS reception at 1575 MHz typically has a core diameter of about 10 mm and the longitudinally extending antenna elements have an average longitudinal extent (i.e. parallel to the cental axis) of about 10.5 mm. The width of the narrow and wide elements is about 0.76 mm and 1.5 mm, respectively. At 1575 MHz, the length of the sleeve $l_B$ is typically in the region of 6 mm. Precise dimensions of the antenna elements can be determined in the design stage on a trial and error basis by undertaking eigenvalue delay measurements until the required phase difference is obtained.

The manner in which the antenna may be manufactured is described in the above-mentioned GB 2292638A.

What is claimed is:

1. A dielectrically-loaded loop antenna for operation at frequencies in excess of 200 MHz, comprising an electrically insulative core of a solid material having a relative dielectric constant greater than 5, a feed connection, and an antenna element structure disposed on or adjacent the outer surface of the core, the material of the core occupying the major part of the volume defined by the core outer surface, wherein the antenna element structure comprises a pair of laterally opposed groups of elongate elements, each group comprising first and second mutually adjacent elongate elements which have different electrical lengths at a frequency within an operating frequency band of the antenna and are coupled together at respective first ends in the region of the feed connection and at respective second ends by a linking conductor extending around the core, the elongate elements of each group thereby defining at least part of an elongate slit which has an electrical length in the region of $n\lambda/2$ within the said band, and the major part of which is located between the elements, and wherein the first elements of the two groups form part of a first looped conductive path, and the second elements of the two groups form part of a second looped conductive path, such that the said paths have different respective resonant frequencies within said band and each extend from the feed connection to the linking conductor, and then back to the feed connection, $\lambda$ being the wavelength of currents in the antenna element structure at said frequency and n being an integer (1, 2, 3, . . . ).

2. The antenna according to claim 1, wherein the slit is located completely between the elements.

3. The antenna according to claim 1, wherein the lenght of the part of the slit located between the elongated elements is at least 0.71, where 1 is the total physical lenght of the slit.

4. The antenna according to claim 1, wherein the core is generally cylindrical and the feed connection is located on an end face of the core.

5. The antenna according to claim 1, wherein the core defines a central axis and the antenna elements are substantially coextensive in the axial direction, each element extending between axially spaced-apart positions on or adjacent the outer surface of the core such that at each of the spaced-apart positions the respective spaced-apart portions of the antenna elements lie substantially in a single plane containing the central axis of the core.

6. A dielectrically-loaded loop antenna for operation at frequencies in excess of 200 MHz, comprising an electrically insulative core of a solid material having a relative dielectric constant greater than 5, a feed connection, and an antenna element structure disposed on or adjacent the outer surface of the core, the material of the core occupying the major part of the volume defined by the core outer surface, wherein the antenna element structure comprises a pair of laterally opposed groups of elongate elements, each group comprising first and second mutually adjacent elongate elements which have different electrical lengths at a frequency within an operating frequency band of the antenna and are coupled together at respective first ends in the region of the feed connection and at respective second ends by a linking conductor extending around the core, the elongate elements of each group thereby defining at least part of an elongate channel which has an electrical length in the region of $n\lambda/2$ within the said band, and the major part of which is located between the elements, and wherein the first elements of the two groups form part of a first looped conductive path, and the second elements of the two groups form part of a second looped conductive path, such that the said paths have different respective resonant frequencies within said band and each extend from the feed connection to the linking conductor, and then back to the feed connection, $\lambda$ being the wavelength of currents in the antenna element structure at said frequency and n being an integer (1, 2, 3, . . . ), wherein one of the elements in each group of elements is of a different width to the other element or elements in that group.

7. The antenna according to claim 1, wherein one of the elements in each group of elements is of a different physical lenght to the other element or elements in the group.

8. The antenna according to claim 1, wherein the core has a central axis of symmetry and the elongate elements are generally helical, each executing a half-turn around the axis.

9. The antenna according to claim 1, including an integral trap arranged to promote a substantially balanced condition at feed connection.

10. The antenna according to claim 1, wherein the linking conductor comprises a cylindrical conductive sleeve on a proximal part of the outer surface of the core, and wherein the proximal end of the sleeve is connected to part of the feeder structure.

11. The antenna according to claim 10, wherein the antenna elements are coupled to the sleeve in the general region of a distal rim of the sleeve.

12. The antenna according to claim 11, wherein the distal rim of the sleeve is substantially planar.

13. The antenna according to claim 1, including a feeder structure passing through the core and connected to the first ends of the antenna elements.

14. A dielectrically-loaded antenna for operation at frequencies above 200MHz, comprising an antenna core having a central axis and made of a solid insulative material having a relative dielectric constant greater than 5, a feeder connection, and an antenna element structure on or adjacent the outer surface of the core forming at least two conductive loops, wherein the antenna elements structure comprises a linking conductor and at least a pair of groups of elongate antenna elements, which groups are laterally opposed on opposite sides of the axis and each comprise at least two mutually adjacent elongate antenna elements each forming part of a respective one of the conductive loops and each extending from a location at or adjacent the feed connection to the linking conductor, wherein said mutually adjacent elements within each group have differing electrical properties such that the two conductive loops have different respectively associated resonant frequencies within a band of operation of the antenna, and wherein said two elements of each group define a respective elongate slit at least the major part of which is between the elements and has an electrical length of substantially $n\lambda/2$ at an operating frequency of the antenna within the band of operation, $\lambda$ being the wavelength of currents in the antenna element structure at said frequency and n being an integer (1, 2, 3, . . . ).

15. The antenna according to claim 14, wherein the fractional bandwidth of the said band of operation at least 5%.

16. The antenna according to claim 14, wherein the two mutually adjacent elements of each group are parallel to each other over the major part of their length.

17. A dielectrically-loaded antenna for operation at frequencies above 200MHz, comprising an antenna core having a central axis and made of a solid insulative material having a relative dielectric constant greater than 5, a feeder connection, and an antenna element structure on or adjacent the outer surface of the core forming at least a pair of loops, wherein the antenna elements structure comprises a linking conductor and at least a pair of groups of elongate antenna elements, which groups are laterally opposed on opposite sides of the axis and each comprise at least two mutually adjacent elongate antenna elements each forming part of a respective one of the conductive loops and each extending from a location at or adjacent the feed connection to the linking conductor, wherein said mutually adjacent elements within each group have differing electrical properties such that the two conductive loops have different respectively associated resonant frequencies within a band of operation of the antenna, and wherein said two elements of each group define a respective elongate slit at least the major part of which is between the elements and has an electrical length of substantially $n\lambda/2$ at an operating frequency of the antenna within the band of operation, wherein the two mutually adjacent elements of each group are parallel to each other over the major part of their length and the two mutually adjacent of each group are parallel conductive tracks of different widths, $\lambda$ being the wavelength of currents in the antenna element structure at said frequency and n being an integer (1, 2, 3, . . . ).

18. The antenna according to claim 14, wherein the core is cylindrical, and wherein the antenna further comprises a feeder structure extending axially through the core from a first end face to a second end face thereof, the feeder structure having one conductor connected at the second end face to the mutually adjacent elements of one of said pair of groups of antenna elements and another conductor of the feeder structure connected to the mutually adjacent elements of the other group of said pair.

19. The antenna according to claim 18, wherein the linking conductor forms part of a trap coupled to the feeder structure in the region of the first end face of the core.

20. The antenna according to claim 18, wherein the groups of said pair of groups follow respective axially coextensive diametrically opposed helical paths centered on the central axis, the ends of the paths lying generally in a common plane containing said central axis.

21. A dielectrically-loaded antenna for operation in a frequency band above 200 MHz, comprising an antenna core made of a solid material having a relative dielectric constant greater than 5, a feed structure extending between first and second locations on the core, and an antenna element structure on or adjacent an outer surface of the core, wherein the antenna element structure comprises at least one group of at least two mutually adjacent elongate elements extending side by side from a first connection with the feed structure at the first location to an interconnection which is coupled to the feed structure at the second location, wherein the electrical properties of said two elongate elements differ such that the antenna exhibits resonances at difference respective frequencies within the band, and wherein said two elongate elements define between them, at least in part, an elongate slit extending substantially from said first connection to the said interconnection, the electrical length of said slit at a frequency f between said resonant frequencies being in the region of $n\lambda/2$, where $\lambda$ is the wavelength of currents in the antenna element structure at the frequency f and n is an integer (1, 2, 3, . . . ).

22. The antenna according to claim 21, wherein the antenna element structure comprises a pair of said groups of antenna elements and the antenna includes a balun coupling said two elongate elements of each said group to the feed structure at said second location.

23. The antenna according to claim 22, wherein the core is cylindrical and has first and second end faces, the groups of said pair of groups being diametrically opposed, and wherein the balun comprises a conductive sleeve having a rim, and each said slit extends from said first end face to said rim.

24. The antenna according to claim 21, wherein the two elongate elements comprise conductive tracks of different respective widths formed on the outer surface of the core.

25. An antenna for operation at frequencies in excess of 200 MHz, comprising an electrically insulative core of a solid material having a relative dielectric constant greater than 5, a feed connection, and an antenna element structure disposed on or adjacent the outer surface of the core and comprising first and second pairs of antenna elements, wherein the elements of each said pair are disposed substantially diametrically opposite one another, the material of the core occupies the major part of the volume defined by the core outer surface, and said elements of the second pair are formed so as to have a greater width than that of said first pair of elements.

26. The antenna according to claim 25, wherein the antenna elements:

wherein each have a first end and a second end, are connected at said first respective ends to said feeder connection, and are joined at said second ends by a linking conductor.

27. The antenna according to claim 25, wherein the core is generally cylindrical and has first and second end faces, and wherein said feed connection is located on one of said end faces.

28. The antenna according to claim 25, wherein the the core defines a central axis and the antenna elements are substantially coextensive in the axial direction, each said antenna element extending between axially spaced-apart positions on or adjacent the outer surface of the core such that at each of the spaced-apart positions, the respective spaced-apart positions of said antenna elements lie substantially in a single plane containing the central axis of the core.

29. The antenna according to claim 25, wherein the antenna elements are helical, each executing a half-turn around the core.

30. The antenna according to claim 25, wherein the link conductor comprises a cylindrical conductive sleeve on a proximal part of the outer surface of the core, and wherein the proximal end of the sleeve is connected to part of the feed structure.

31. The antenna according to claim 31, wherein the digital rim of the sleeve is generally planar.

32. A dielectric-loaded quadrifilar helical antenna having pairs of laterally opposed antenna elements formed as conductive helical tracks on or adjacent the outer surface of a solid core of material having a relative dielectric constant greater than 5, wherein the tracks of one pair are wider than the tracks of the other pair.

33. A handheld radio communication unit having a radio transceiver, an integral earphone for directing sound energy from an inner face of the unit which, in use, is placed against the user's head, and the antenna as claimed in claim 28 coupled to the transceiver generally perpendicular to said single plane, and wherein the antenna is so mounted in the unit that the null is directed generally perpendicular to said inner face of the unit to reduce the level of radiation from the unit in the direction of the user's head.

34. The unit according to claim 33, wherein:

the core is cylindrical and has first and second end faces;

said antenna elements arc helical, each executing a half turn about the central axis and each have a first end and a second end;

the antenna has a feed connection associated with said first end face and coupled to said first antenna element ends; and the antenna has a linking conductor formed by a conductive sleeve encircling the cylinder so as to link said second antenna element ends and to form an isolating trap.

35. The unit according to claim 34, wherein said feed connection forms the end of an axial feeder structure passing through the end of the core.

* * * * *

UNITED STATES PATENT AND TRADEMARK OFFICE

CERTIFICATE OF CORRECTION

PATENT NO. : 6,300,917 B1
DATED : October 9, 2001
INVENTOR(S) : Leisten et al.

It is certified that error appears in the above-identified patent and that said Letters Patent is hereby corrected as shown below:

Column 10,
Line 24, please delete "elements" and insert -- elongate elements -- therefor.

Column 11,
Line 3, please delete "lenght" and insert -- length -- therefor; and please delete "the group" and insert -- that group -- therefor.
Line 29, please delete "elements" and insert -- element -- therefor.
Line 58, please delete "a pair of" and insert -- two conductive -- therefor.
Line 59, please delete "elements" and insert -- element -- therefor.

Column 12,
Line 10, please delete "adjacent" and insert -- adjacent elements -- therefor.

Column 14,
Line 1, please delete "claim 31" and insert -- claim 30 -- therefor.

Signed and Sealed this

Twenty-third Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,300,917 B1
DATED : October 9, 2001
INVENTOR(S) : Leisten et al.

It is certified that error appears in the above-identified patent and that said Letters Patent is hereby corrected as shown below:

Column 1,
Line 22, please delete “wherein”.
Line 59, please delete “difference” and insert -- different -- therefor.

Column 2,
Line 4, please delete “difference” and insert -- different -- therefor.

Column 6,
Line 26, please delete “At” and insert -- As -- therefor.

Column 7,
Line 62, please delete “form a” and insert -- form of a -- therefor.

Column 9,
Line 12, please delete “$e_r$” and insert -- $\epsilon_r$ -- therefor.

Signed and Sealed this

Twenty-fourth Day of September, 2002

*Attest:*

*Attesting Officer*

JAMES E. ROGAN
*Director of the United States Patent and Trademark Office*